US005916083A

United States Patent [19]

Björkström

[11] Patent Number: 5,916,083

[45] Date of Patent: Jun. 29, 1999

[54] ROTOR FOR A CENTRIFUGAL SEPARATOR WITH SOUND REDUCTION

[75] Inventor: Rolf Björkström, Älvsjö, Sweden

[73] Assignee: Alfa Laval AB, Lund, Sweden

[21] Appl. No.: 08/849,527

[22] PCT Filed: Nov. 13, 1996

[86] PCT No.: PCT/SE96/01463

§ 371 Date: Jun. 10, 1997

§ 102(e) Date: Jun. 10, 1997

[87] PCT Pub. No.: WO97/18900

PCT Pub. Date: May 29, 1997

[30] Foreign Application Priority Data

Nov. 17, 1995 [SE] Sweden ..... 9504100

[51] Int. Cl.[6] ..... B04B 1/14

[52] U.S. Cl. ..... 494/56; 494/70

[58] Field of Search ..... 494/2–4, 40, 43, 494/56, 68–73, 82, 85

[56] References Cited

U.S. PATENT DOCUMENTS 1,921,181 8/1933 Fawcett ..... 494/3

FOREIGN PATENT DOCUMENTS 3606522 5/1987 Germany ..... 494/3

7201283 11/1973 Netherlands ..... 494/2

*Primary Examiner*—Charles E. Cooley

*Attorney, Agent, or Firm*—Fish & Richardson P.C.

[57] ABSTRACT

Rotor for a centrifugal separator, which rotor (1) during operation rotates in a space (4) and inside itself forms a chamber (12) and a passage (7), which extends radially outwardly from the chamber (12) to the outside of the rotor (1). In order to accomplish at low costs such a rotor (1), in which gas present in the chamber (12) and in the passage (7) does not generate sound the passage (7) in the rotor is designed with a radially outer portion (13), which extends radially inwardly from the outside of the rotor (1), and which has a cross-section perpendicular to the central axis of the passage (7), which in a plane perpendicular to the rotation axis through the central axis has an extension, which continuously decreases by the distance from the outside of the rotor (1) to a radially inner cross-section, which has a certain extension in this plane and from the outside of the rotor (1) is located at a distance along the central axis, which at least is one third of the extension of the radially inner cross-section in said plane, and that the extension of the cross-section of the passage (7) at the outside of the rotor (1) in the plane is between four and nine thirds of the extension of the radially inner cross-section in said plane.

9 Claims, 4 Drawing Sheets

ROTOR FOR A CENTRIFUGAL SEPARATOR WITH SOUND REDUCTION

FIELD OF THE INVENTION

The present invention concerns a rotor for a centrifugal separator. This rotor is arranged to rotate during operation around a rotational axis in a space in the centrifugal separator in contact along its outside with a gas present in the space. Inside itself the rotor forms at least one chamber and at least one passage, which with a central axis extends radially outwardly from the chamber to the outside of the rotor and connects the chamber with the space outside the rotor. The chamber and the passage are arranged to allow normal intermittent flow therethrough of a component separated in the rotor during operation of the device.

BACKGROUND OF THE INVENTION

In order not to have the chamber and the passage clogged and not to have the separated component which flows through the passage causing unacceptable wear of the rotor body by erosion, the chamber and the passage in many rotors of known centrifugal separators have a complicated shape, which they obtain by an expensive disc mill cutting operation on both the inside and the outside of the rotor body.

During operation rotors of this kind also generate sound, which in many cases exceeds the sound level which can be accepted. This is particularly the case for rotors, which rotate at a relatively high number of revolutions. An often significant part of the occurring sound is generated in chambers and passages of the mentioned kind. This sound is enhanced by the gas, usually in the form of air, which is located in the space, when during operation of the rotor, it passes the openings towards the space of the passages. The frequencies of the generated sound, the pressure waves, are controlled by the geometric shape and dimensions of the chamber and the passages.

In DE 1 298 449 a simpler design of passages of this kind in a centrifugal separator is shown. In the rotor known hereby a number of passages in the shape of circular cylindrical holes, which are distributed around the rotational axis and radially directed, connect a chamber, which is formed inside the rotor and surrounds the rotational axis, with the space outside the rotor. By designing the chamber and the passages in this manner the manufacturing cost can be reduced considerably.

However, it is very easy for gas, which is located in circular cylindrical holes of this kind, to be excited in the same manner as the gas in an organ pipe by a gas, passing by the opening of the hole and be set in oscillation and thereby generate sound at a certain frequency.

SUMMARY OF THE INVENTION

The object of the present invention is to accomplish a rotor of the kind initially described at low manufacturing costs for a centrifugal separator having a chamber and at least one passage, which are so designed that a separated component can flow through the same without a risk of clogging or wear and so that gas, which during operation is located in the chamber and the passage, is not excited so as to generate sound.

This is accomplished by the present invention by designing the passage with a radially outer portion, which extends radially inwardly from the outside of the rotor, and which perpendicular to the central axis of the passage has a cross-section, which in a plane perpendicular to the rotation axis through the central axis has an extension which continuously decreases by the distance from the outside of the rotor to a radially inner cross-section, which has a certain extension in this plane and from the outside of the rotor is located at a distance along the central axis, which at least is one third of the extension in said plane of the radial inner cross-section, and that the extension of the cross-section of the passage, at the outside of the rotor in the plane is between four and nine thirds of the extension of the radially inner cross-section in said plane.

In one embodiment of the invention the radial outer portion of the passage has a circular cross-section.

The radial outer portion of the passage then can either have a spherical shape with a center through which the central axis extends, or a conical shape around an axis of symmetry, which coincides with the central axis.

In a modified embodiment of the invention the radial outer portion of the passage has an elliptic cross-section, the major axis of the ellipse being directed in the circumferential direction.

In another embodiment of the invention the passage in the plane perpendicular to the rotational axis through the central axis radially inwardly has a continuously from the outside of the rotor decreasing extension perpendicular to the central axis on both sides of the central axis.

In a further embodiment of the invention the passage also comprises a radially inner circular cylindrical portion, which is located radially inside the radially outer portion of the passage.

In a suitable embodiment of the invention the passage is straight and directed completely radially but as an alternative it can be straight and as seen radially outwardly be directed backwardly in the rotational direction.

BRIEF DESCRIPTION OF THE DRAWINGS

In the following the invention will be described more closely with reference to the attached drawings, in which FIG. 1 schematically shows a centrifugal separator (partly in an axial section), which is provided with a rotor according to the invention.

DETAILED DESCRIPTION

Figure 1:
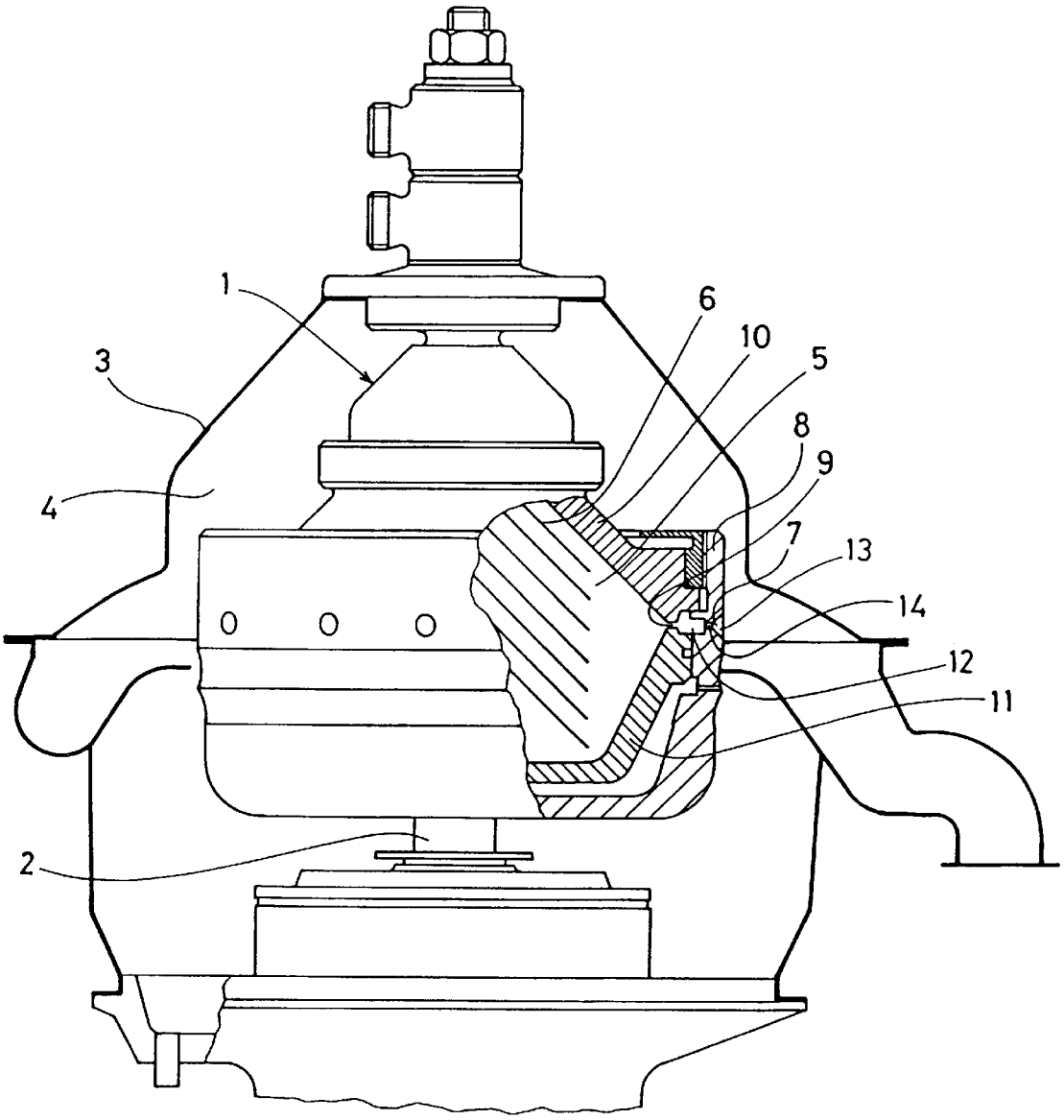

The centrifugal separator shown in FIG. 1 has a rotor 1, which is supported by and driven by a driving shaft 2. The rotor 1 is surrounded by a stationary casing 3, which forms a space 4, in which the rotor 1 during operation rotates in contact with the air or other gas, which is located in the space 4, along its outside. Inside itself the rotor 1 forms a separation chamber 5, in which a stack of separation discs 6 is arranged. Between these separation discs 6 the main centrifugal separation during operation takes place, a specific light component, which is separated out of a supplied liquid mixture of components flows radially inwardly while a specific heavier separated component in the form of a liquid or a sludge flows radially outwardly and is accumulated in the radially outermost part of the separation chamber 5.

When needed or at equal time periods all or part of the content of the separation chamber 5 is thrown out through a passage 7, which extends with a central axis radially through the wall 8 of the rotor 1, by opening an annular gap 9 surrounding the rotational axis between a rotor cover 10 and an axially movable valve slide 11. Between the gap 9 and the passages 7 there is a chamber 12 arranged, which is delimited by the rotor wall 8, the rotor cover 10 and the valve slide 11.

The passage 7 has a radially outer portion 13, which extends radially inwardly from the outside of the rotor 1. Perpendicular to the central axis of the passage this outer portion 13 has a cross-section, which in a plane perpendicular to the rotational axis through the central axis has an extension, which continuously decreases by the distance from the outside of the rotor 1 to a radially inner cross-section. This radially inner cross-section has a certain extension in the plane and is located at a distance along the radially directed central axis from the outside of the rotor 1, which at least is one third of the extension of the inner cross-section in this plane. At the outside of the rotor the extension of the cross-section of the passage 7 in the plane is five thirds of the extension of the radially inner cross-section.

In the example shown in FIG. 1 of a rotor 1 according to the invention the passage also comprises a radially inner portion 14, which connects to the radially outer portion 13 at said radially inner cross-section from where it extends radially inwardly to the chamber 12 in a way such that this chamber 12 communicates with the space 4 outside the rotor 1 via the passage 7. The radial inner portion 14 is circular cylindrical while the radial outer portion 13 in this example is frusto-conical with the apex directed radially inwardly. The central axis of the passage 7 is straight and extends completely radially in the rotor.

Figure 2:
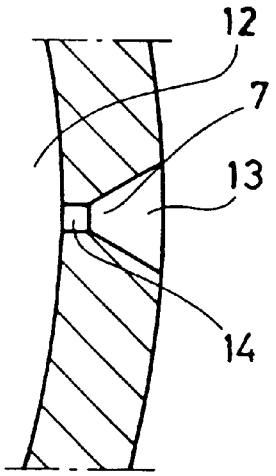
FIG. 2 shows a radial section through a portion of a rotor according to an embodiment of the invention.

FIG. 2 shows in more detail the passage 7 shown in FIG. 1 seen in a radial section through the central axis of it.

Figure 3:
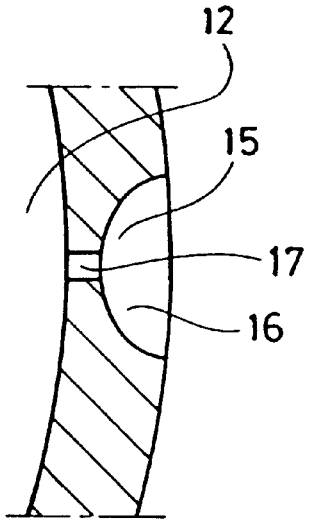
FIG. 3 shows a radial section through a portion of a rotor according to another embodiment of the invention.

FIG. 3 shows another example of how a passage 15 can be designed seen in a radial section through its central axis, which also in this example is straight and extends totally radially in the rotor. This passage 15 has a spherical radial outer portion 16 and a circular cylindrical radially inner portion 17.

Figure 4:
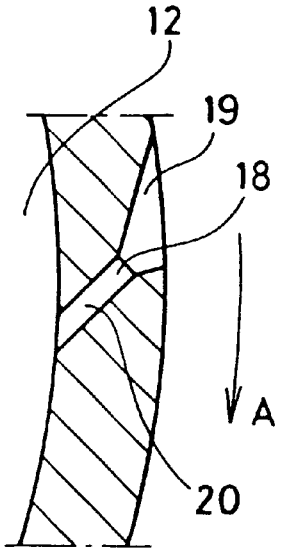
FIG. 4 shows a radial section through a portion of a rotor according to an alternative embodiment of the invention.

In the example shown in FIG. 4 of a design of a passage 18 seen in a radial section through its central axis the central axis is straight but seen radially outwardly directed backwardly in the rotational direction, which is indicated with an arrow A. As with the passage 7 shown in FIGS. 1 and 2 this passage 18 has a radially outer frusto-conical portion 19 and a radially inner circular cylindrical portion 20.

Figure 5:
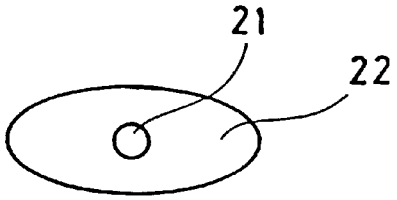
FIG. 5 shows a view radially from the outside of a detail of the rotor according to a modified embodiment of the invention.

FIG. 5 shows a view radially from the outside of a modified passage 21, which is designed with a radially outer portion 22 with an elliptic cross-section, the major axis of the ellipse being oriented in the circumferential direction.

Figure 6:
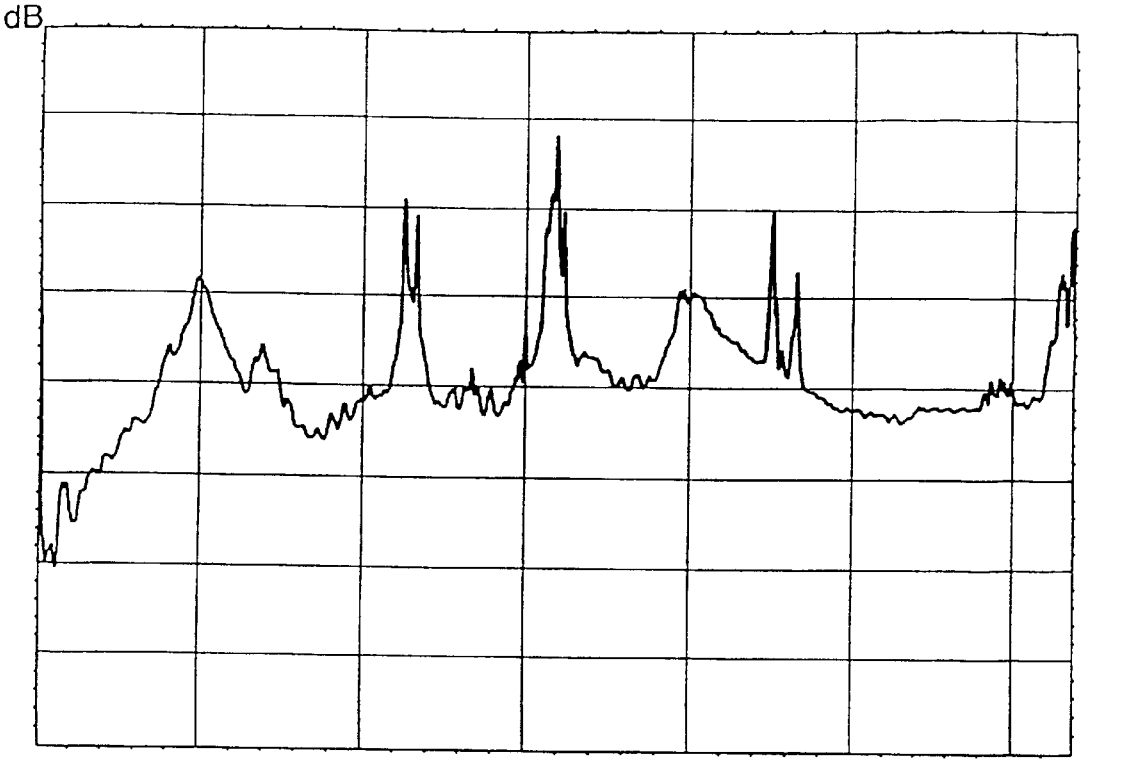
FIG. 6 shows a diagram of the frequency spectrum of the sound level for sound generated during operation of passages in rotors of the kind previously known.
Figure 7:
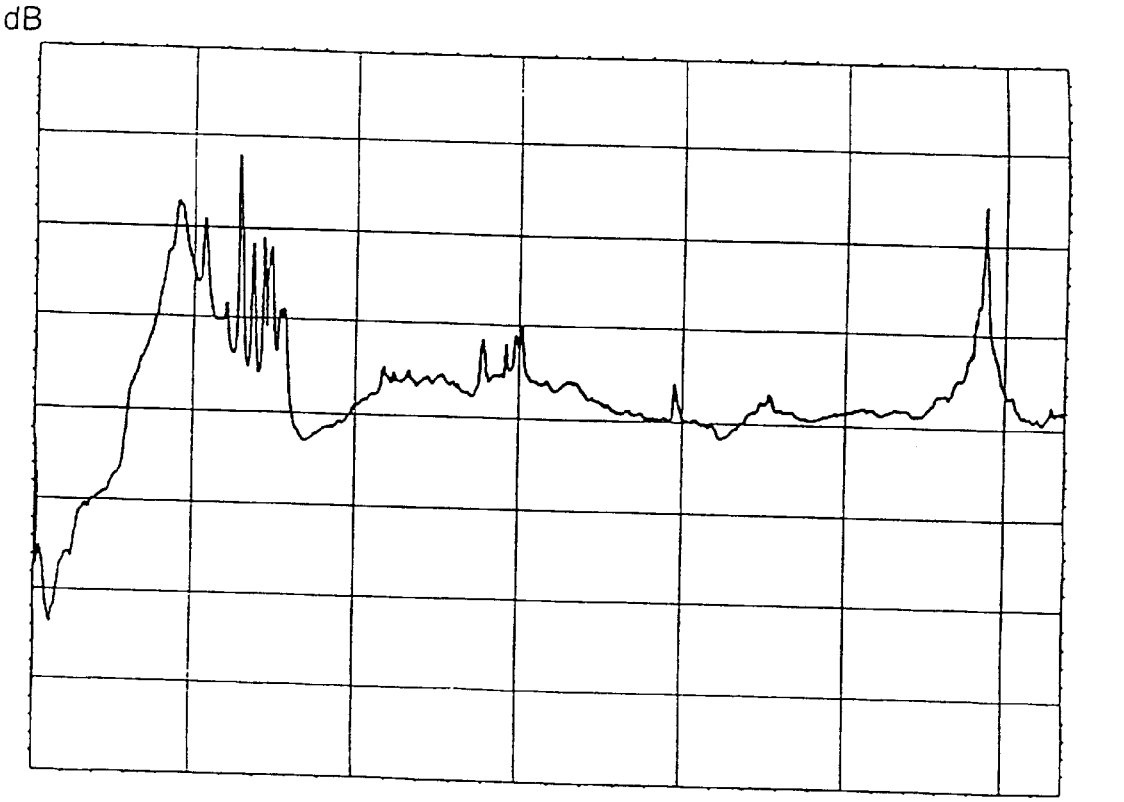
FIG. 7 shows a diagram of the frequency spectrum of the sound level for sound generated during operation of other passages in a rotor.
Figure 8:
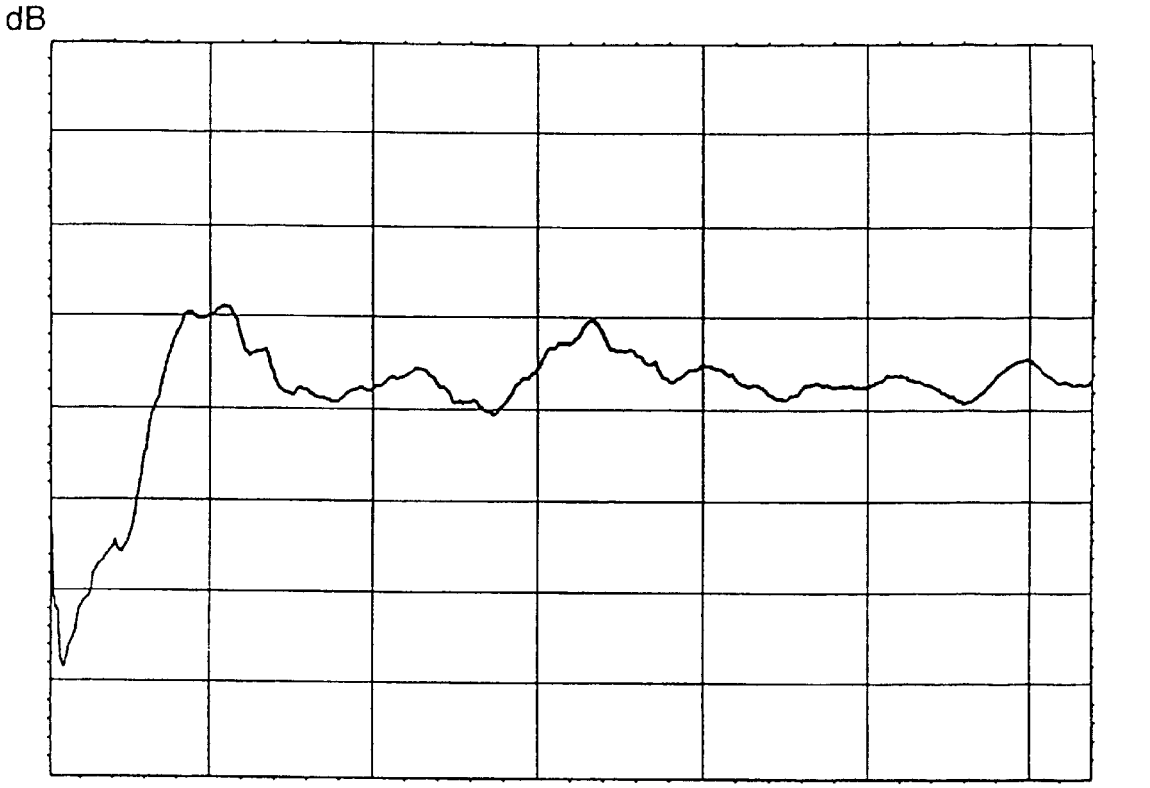
FIG. 8 shows a diagram of the frequency spectrum of the sound level for sound generated during operation of passages in a rotor according to the present invention.
Figure 6:
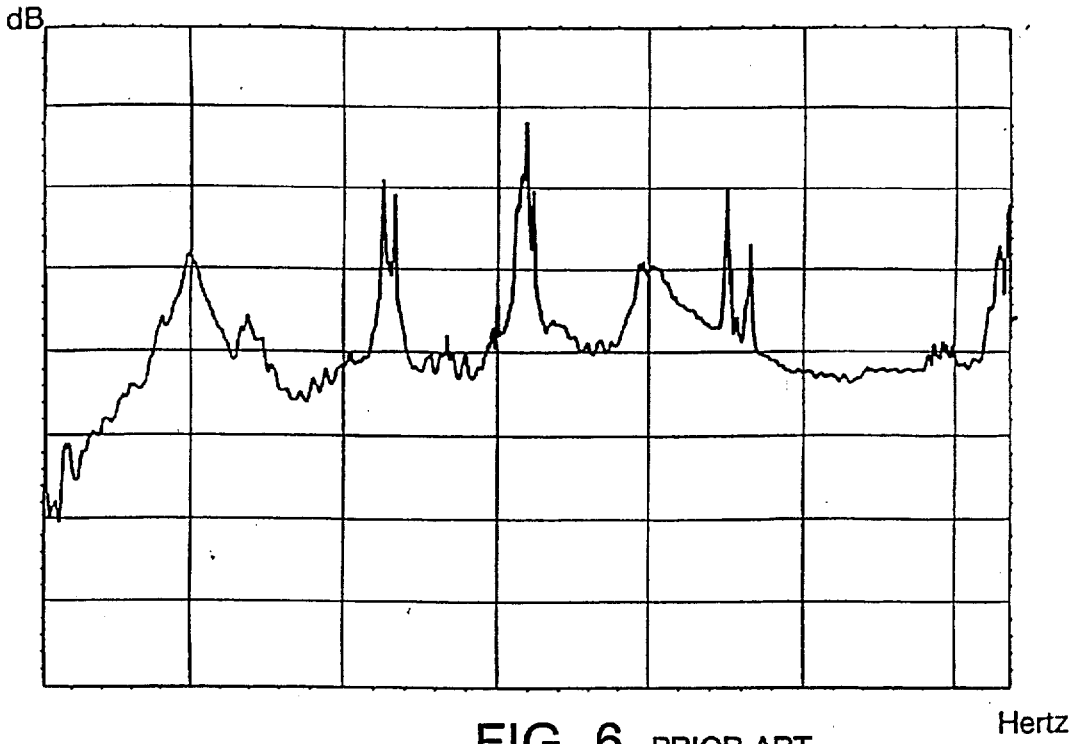
FIG. 6 PRIOR ART
Figure 7:
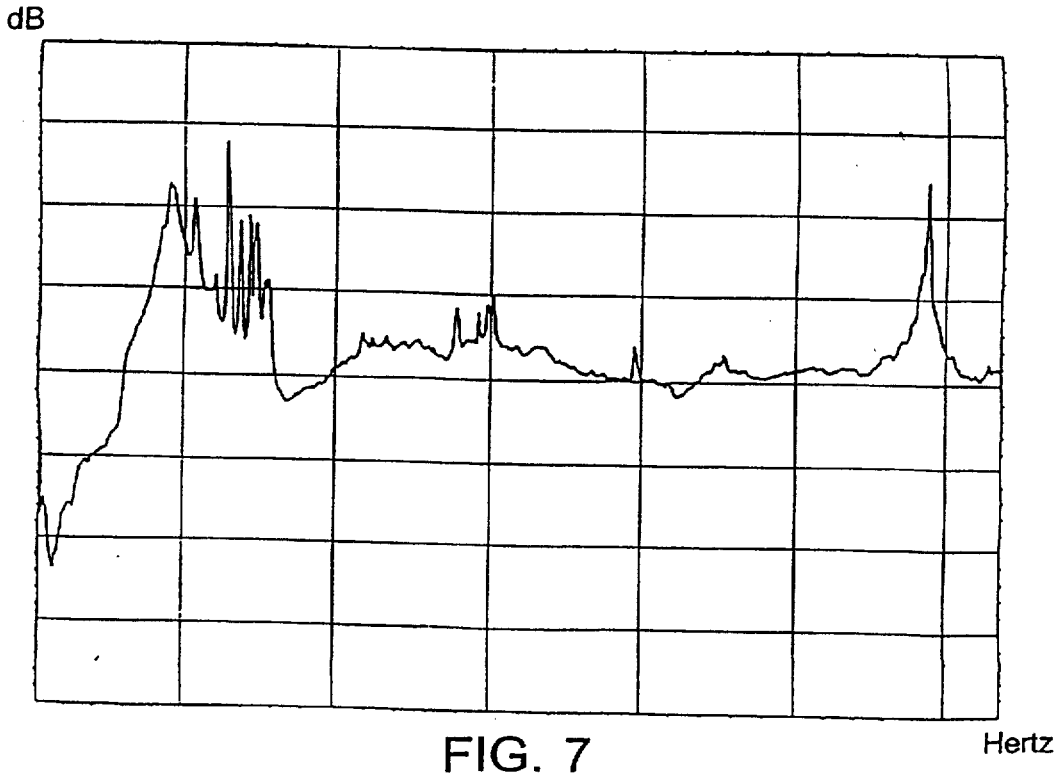

In order to illustrate the technical effect of the present invention the FIGS. 6–8 show diagrams of the measured frequency spectrum of the sound level for three different designs of passages of this kind.

In FIG. 6 the frequency spectrum of the sound level for circular cylindrical passages is shown without any radially outer portion of the kind, which the passages in a rotor according to the present invention have according to the above.

In FIG. 7 there is shown a frequency spectrum with a sound level for circular cylindrical passages, which in the same way as the passage in the rotor according to the present invention has a radially outer portion, which extends radially inwardly from the outside of the rotor, and perpendicular to the central axis of the passage has a cross-section, which in a plane perpendicular to the rotational axis through the central axis has an extension, which continuously decreases by the distance from the outside of the rotor to a radially inner cross-section, which has a certain extension in this plane but is located from the outside of the rotor at a distance along the central axis, which is shorter than one third of the extension of the radially inner cross-section in said plane.

From these two diagrams it is evident that the generated sound has a basic back noise level, to which a number of excited tones are added. From the diagram in FIG. 7 it is also evident that tones of this kind are excited and added to the back noise level even if the passage or the passages are provided with a short radially outer portion of this kind.

The diagram in FIG. 8 shows that if a passage is designed in the way the passage in a rotor according to the present invention is, in which the radial cross-section of the passage is located at a distance from the outside of the rotor, which at least is one third of the extension of the radial inner cross-section in the plane perpendicular to the rotational axis through the central axis, the excitation of tones is reduced so substantially that only the back noise level of the sound remains.

What is claimed is:

1. A rotor for a centrifugal separator, the rotor (1) being arranged in a space (4) in the centrifugal separator to be rotatable during operation in a rotational direction around a rotational axis and having an outside in contact with a gas present in the space (4), at least one chamber (12) and at least one passage (7, 15, 18, 21) being formed inside the rotor, the passage having a central axis extending radially outwardly from the chamber (12) to the outside of the rotor and connecting the chamber (12) with the space (4) outside the rotor, such that a component separated in the rotor during operation thereof can flow through the chamber (12) and the passage (7, 15, 18, 21), wherein the passage (7, 15, 18, 21) comprises a radially outer portion (13, 16, 19, 22), which extends radially inwardly from the outside of the rotor, and which has a cross-section perpendicular to the central axis of the passage (7, 15, 18, 21), the cross-section having an extension in a plane perpendicular to the rotational axis through the central axis, the cross-section decreasing continuously by the distance from the outside of the rotor (1) to a radial inner cross-section, the inner cross-section having a certain extension in said plane and being located from the outside of the rotor at a distance along the central axis, which is at least one third of the extension of the radial inner cross-section, and wherein the extension of the cross-section of the passage (7, 15, 18, 21) at the outside of the rotor in the plane is between four and nine thirds of the extension of the radial inner cross-section in said plane.

2. The rotor according to claim 1, wherein said outer portion (13, 16, 19) of the passage (7, 15, 18) has a circular cross-section.

3. The rotor according to claim 2, wherein said outer portion (16) of the passage (15) has a spherical shape with a center, through which the central axis extends.

4. The rotor according to claim 2, wherein said outer portion (13, 19) of the passage (7, 18) has a conical shape around an axis of symmetry, said axis of symmetry coinciding with the central axis.

5. The rotor according to claim 1, wherein said radially outer portion (22) of the passage (21) has an elliptic cross-section with the major axis of the ellipse being directed essentially in a circumferential direction.

6. The rotor according to claim 1, wherein the passage (7, 15, 18, 21) has an extension perpendicular to the central axis that decreases radially inwardly from the outside of the rotor along a portion of the passage (7, 15, 18, 21) continuously on both sides of the central axis.

7. The rotor according to claim 1, wherein the passage (7, 15, 18, 21) also comprises a radially inner circular cylindrical portion (14, 17, 20), which is located radially inside the radially outer portion (13, 16, 19) of the passage (7, 15, 18, 21).

8. The rotor according to claim 1, wherein the passage (7, 15, 21) is straight and directed completely radially.

9. The rotor according to claim 1, wherein the passage (18) is straight and seen radially outwardly is directed backwardly in the rotational direction.

* * * * *

UNITED STATES PATENT AND TRADEMARK OFFICE

CERTIFICATE OF CORRECTION

PATENT NO. : 5,916,083

DATED : 06/29/99

INVENTOR(S) : Rolf Bjorkstrom

It is certified that error appears in the above-identified patent and that said Letters Patent is hereby corrected as shown below:

On the cover page, under References Cited, add the following U.S. and foreign references:

| | | |
|---|---|---|
| 5,202,024 | 04/13/93 | Andersson et al. |
| 5,033,680 | 07/23/91 | Schultz |
| 4,820,257 | 04/11/89 | Ishimaru |
| 1 298 449 | 06/26/69 | DE |

Delete Fig. 6 and replace with per attached Fig. 6

Signed and Sealed this

Twenty-second Day of August, 2000

*Attest:*

*Attesting Officer*

Q. TODD DICKINSON

*Director of Patents and Trademarks*